US009537273B2

(12) United States Patent
Tobey

(10) Patent No.: US 9,537,273 B2
(45) Date of Patent: Jan. 3, 2017

(54) ELECTRICAL CONNECTOR WITH CONTACTS OF MULTIPLE MATERIALS

(71) Applicant: Tyco Electronics Corporation, Berwyn, PA (US)

(72) Inventor: Shawn Phillip Tobey, Trinity, NC (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/798,062

(22) Filed: Jul. 13, 2015

(65) Prior Publication Data

US 2016/0072239 A1 Mar. 10, 2016

Related U.S. Application Data

(63) Continuation of application No. 14/186,685, filed on Feb. 21, 2014, now Pat. No. 9,083,096.
(Continued)

(51) Int. Cl.
*H01R 24/00* (2011.01)
*H01R 24/64* (2011.01)
(Continued)

(52) U.S. Cl.
CPC ..... *H01R 24/64* (2013.01); *H01R 13/17* (2013.01); *H01R 13/6474* (2013.01);
(Continued)

(58) Field of Classification Search
CPC ..... H01R 13/6461–13/6477
(Continued)

(56) References Cited

U.S. PATENT DOCUMENTS 5,186,647 A * 2/1993 Denkmann ..... H01R 13/6467 439/108
5,244,402 A 9/1993 Pasterchick, Jr. et al.
(Continued)

FOREIGN PATENT DOCUMENTS

JP 2009-164087 7/2009

OTHER PUBLICATIONS

International Search Report and Written Opinion for PCT/US2014/017598—mailed May 26, 2014.

*Primary Examiner* — Chandrika Prasad
(74) *Attorney, Agent, or Firm* — Merchant & Gould P.C.

(57) ABSTRACT

A telecommunications jack, and a method of manufacturing such a jack, are disclosed. In one aspect, the jack includes a housing having a socket sized to receive either a first telecommunications plug of a first type or a second telecommunications plug of a second type having a different arrangement of electrical contacts as compared to the first telecommunications plug. The telecommunications jack also includes a plurality of contact springs exposed within the socket and positioned for alignment with electrical contacts of the first telecommunications plug when the first telecommunications plug is inserted into the socket. At least one of the contact springs remains unaligned with any of the electrical contacts of the second telecommunications plug when the second telecommunications plug is inserted into the socket, and is a resilient conductive material, At least one other contact spring of the plurality of contact springs are a second material having a lower resiliency than the at least one of the contact springs.

20 Claims, 7 Drawing Sheets

Related U.S. Application Data

(60) Provisional application No. 61/768,217, filed on Feb. 22, 2013.

(51) Int. Cl.

| | |
|---|---|
| ***H01R 13/6474*** | (2011.01) |
| ***H01R 27/00*** | (2006.01) |
| ***H01R 13/17*** | (2006.01) |
| *H01R 13/03* | (2006.01) |
| *H01R 107/00* | (2006.01) |

(52) U.S. Cl.
CPC ..... *H01R 27/00* (2013.01); *H01R 13/03* (2013.01); *H01R 2107/00* (2013.01); *Y10T 29/49208* (2015.01)

(58) Field of Classification Search
USPC ..... 439/676
See application file for complete search history.

(56) References Cited

U.S. PATENT DOCUMENTS

| | | | | |
|---|---|---|---|---|
| 5,647,767 | A | 7/1997 | Scheer et al. | |
| 5,772,466 | A | 6/1998 | Morin et al. | |
| 6,120,329 | A * | 9/2000 | Steinman | H01R 13/6461 439/676 |
| 6,338,656 | B1 | 1/2002 | Oliphant et al. | |
| 6,368,160 | B2 | 4/2002 | Chang | |
| 6,375,516 | B1 * | 4/2002 | Trinh | H01R 24/64 439/676 |
| 6,749,444 | B2 * | 6/2004 | Murr | H01R 23/688 439/620.01 |
| 6,890,197 | B2 | 5/2005 | Liebenow | |
| 7,985,101 | B2 * | 7/2011 | Fitzpatrick | H01R 13/64 439/676 |
| 9,083,096 | B2 * | 7/2015 | Tobey | H01R 13/17 |
| 2002/0086586 | A1 * | 7/2002 | Shi | H01R 4/48 439/676 |
| 2002/0160662 | A1 | 10/2002 | Arnett et al. | |
| 2004/0127105 | A1 | 7/2004 | Itano et al. | |
| 2005/0191909 | A1 | 9/2005 | Leong et al. | |
| 2009/0186532 | A1 | 7/2009 | Goodrich et al. | |
| 2009/0269978 | A1 * | 10/2009 | Pepe | H01R 13/6658 439/541.5 |
| 2010/0190366 | A1 * | 7/2010 | Fitzpatrick | H01R 13/64 439/147 |
| 2012/0188865 | A1 | 7/2012 | Michaelis et al. | |
| 2014/0293994 | A1 * | 10/2014 | Pepe | G02B 6/4284 370/352 |

* cited by examiner

ELECTRICAL CONNECTOR WITH CONTACTS OF MULTIPLE MATERIALS

CROSS-REFERENCE TO RELATED APPLICATIONS

This application is a continuation of application Ser. No. 14/186,685, filed Feb. 21, 2014, which application claims priority to provisional application Ser. No. 61/768,217, filed Feb. 22, 2013, which applications are incorporated herein by reference in their entirety.

TECHNICAL FIELD

The present application relates generally to construction of an electrical connector. In particular, the present application relates to an electrical connector with multiple contact array materials.

BACKGROUND

Electrical connectors, for example those used in connection with differential signaling, twisted pair wiring, have a variety of different formats. For example, an RJ-11 electrical connector can have either two or three pairs of wires, or either four or six total wires. An RJ-45 electrical connector typically has four pairs of wires, representing eight total wires. Other types of electrical connectors have differing numbers of wires as well.

In some cases, the physical characteristics of a particular electrical connector allow that connector to be compatible with electrical connectors of alternative formats. For example, RJ-11 plugs having four wires are often constructed to fit in the same housing as an RJ-11 plug having six wires; accordingly, both variants can fit into the same RJ-11 jack. Similarly, RJ-45 jacks generally have a greater width than RJ-11 jacks, but are otherwise similarly sized. As such, RJ-45 jacks can receive an RJ-11 plug, when such a plug is either intentionally, or sometimes unintentionally, inserted.

The size similarities and physical compatibility of electrical connectors of various types can, at times, lead to drawbacks. For example, although a plug can be inserted into a mismatched (yet physically compatible) jack in some circumstances, the contacts of the plug may not directly correspond to or align with the contacts of the mismatched jack. For example, an RJ-11 plug can be inserted into the physical opening of an RJ-45 jack, but because of the different number and arrangement of wire pairs, contacts of the RJ-11 plug will not align with at least the two outermost contact springs of the RJ-45 jack (typically designated as pins 1 and 8). This misalignment of wires can lead to undue stress on the electrical connector. For example, in the event of insertion of an RJ-11 plug into an RJ-45 jack, it is often the case that a plastic housing portion of the RJ-11 plug engages the outermost contact springs of an RJ-45 jack, causing them to deform much more than would otherwise occur when those contact springs engage wires of a plug.

This insertion of a physically similar plug does not necessarily harm the RJ-45 jack during an initial insertion of that RJ-11 plug. However, RJ-45 jacks (and other such connectors) are designed to have a finite life span, typically referred to as a minimum number of insertions of a plug into the jack before the resiliency of the contact springs of the jack may become unreliable. When an RJ-11 plug is inserted, the increased deformation of contact springs in the RJ-45 jack results in decreased lifespan of the jack, due to loss of resiliency of the outermost contact springs.

To ensure that RJ-45 jacks have adequate life, the contact springs of the RJ-45 jack can be manufactured from a beryllium-copper material, which has good resiliency even when deflected a relatively large distance. However, this material can be expensive, difficult to obtain, and environmentally hazardous when disposed of.

For these and other reasons, improvements are desirable.

SUMMARY

In accordance with the following disclosure, the above and other issues are addressed by the following:

In a first aspect, a telecommunications jack includes a housing having a socket sized to receive either a first telecommunications plug of a first type or a second telecommunications plug of a second type, the second telecommunications plug having a different arrangement of electrical contacts as compared to the first telecommunications plug. The jack includes a plurality of contact springs exposed within the socket, the plurality of contact springs positioned for alignment with electrical contacts of the first telecommunications plug when the first telecommunications plug is inserted into the socket. At least one of the contact springs remains unaligned with any of the electrical contacts of the second telecommunications plug when the second telecommunications plug is inserted into the socket. The at least one of the contact springs that remains unaligned with any of the electrical contacts of the second telecommunications plug comprises a resilient conductive material, and at least one other contact spring of the plurality of contact springs comprises a second material having a lower resiliency than the at least one of the contact springs.

In a second aspect, a method of constructing a telecommunications jack includes forming a first plurality of electrical leads from a first material, the first plurality of electrical leads including contact springs, and forming a second plurality of electrical leads from a second material, the second plurality of electrical leads including second contact springs. The method further includes positioning the first and second pluralities of electrical leads within a housing having a socket, thereby forming an electrical jack. The first material comprises a resilient conductive material and the second material comprises a second conductive material having a lower resiliency as compared to the first material.

In a third aspect, a telecommunications jack includes a housing having a socket sized to receive either an RJ-45 plug or an RJ-11 plug. The telecommunications jack further includes first, second, third, fourth, fifth, sixth, seventh, and eighth contact springs exposed within the socket, the plurality of contact springs positioned for alignment with electrical contacts of RJ-45 plug when the RJ-45 plug is inserted into the socket. The first and eighth contact springs are engaged by a body of the RJ-11 plug when the RJ-11 plug is inserted into the socket, but remain disconnected from electrical contacts of the RJ-11 plug. The first and eighth contact springs are formed from a resilient conductive material, and wherein at least one of the second, third, fourth fifth, sixth, and seventh contact springs of the plurality of contact springs are formed from a second material having a lower resiliency than the of the contact springs.

DETAILED DESCRIPTION

Figure 1:
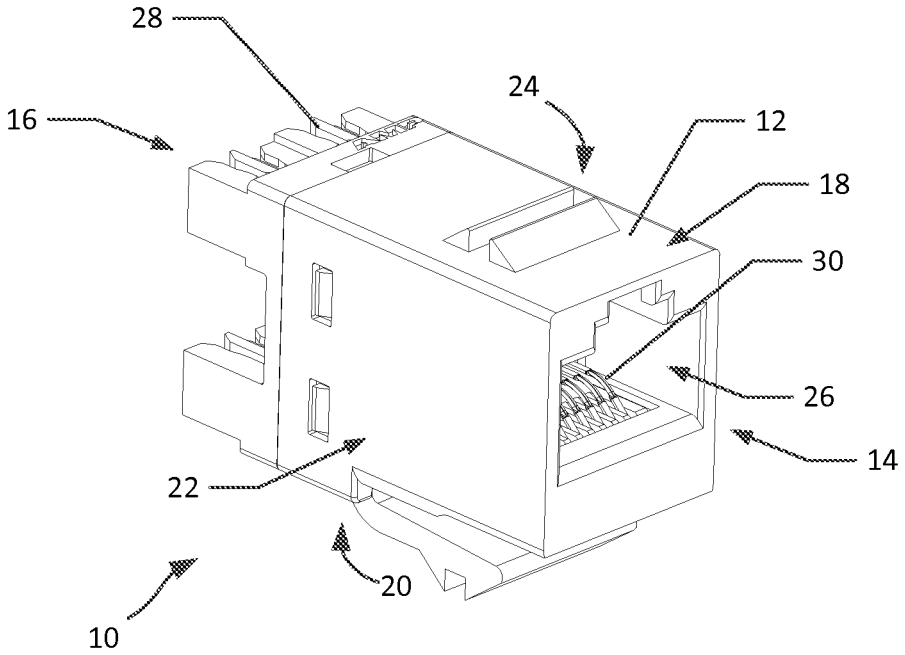
FIG. 1 is a perspective view of a telecommunications jack in which aspects of the present disclosure can be implemented.
Figure 3A:
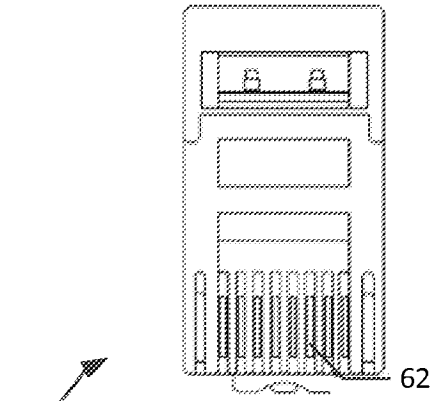
FIG. 3A is a top plan view of an RJ-45 plug useable with the telecommunications jack of FIG. 1.
Figure 3B:
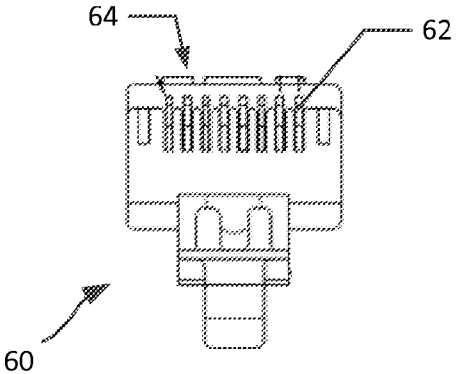
FIG. 3B is a front plan view of an RJ-45 plug useable with the telecommunications jack of FIG. 1.
Figure 2A:
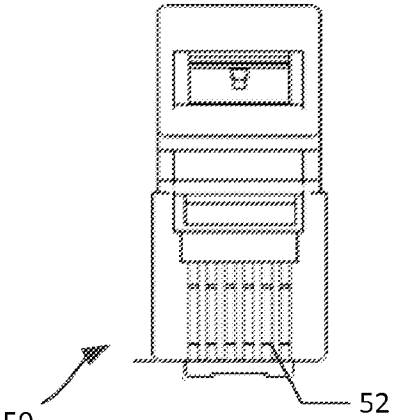
FIG. 2A is a top plan view of an RJ-11 plug useable with the telecommunications jack of FIG. 1.
Figure 2B:
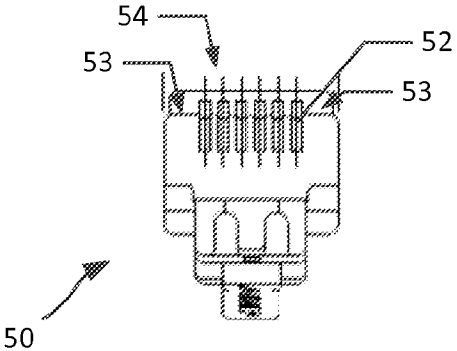
FIG. 2B is a front plan view of an RJ-11 plug useable with the telecommunications jack of FIG. 1.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In general the present disclosure relates to a telecommunications jack and methods of construction of such a jack. In various embodiments of the present disclosure, the telecommunications jack has contact springs constructed from materials of varying resiliencies and costs, thereby ensuring that contact springs possibly deflected to an extent greater than other contact springs (e.g., by a mis-matched plug having a different but size-compatible format to the telecommunications jack) are not fatigued to the extent that electrical continuity is risked.

Referring now to FIG. 1, an example telecommunications jack 10 is shown in which the contact spring arrangements discussed herein are illustrated. The telecommunications jack has a housing 12, and includes a front side 14, a rear side 16, top and bottom sides 18, 20, and left and right sides 22, 24, respectively. The front side 14 has a plug receptacle 26 sized to receive a telecommunications plug having a complementary geometry to the plug receptacle. The plug receptacle 26 can be sized to receive any of a variety of types of telecommunications plugs; in the example embodiment shown, the plug receptacle is sized and shaped to receive an RJ-45 plug; however, in alternative embodiments, other sizes or geometries of receptacles could be used.

In the embodiment shown, the telecommunications jack 10 is configured for use with twisted pair cabling. As generally seen in FIG. 1, the telecommunications jack 10 has a rear side having a plurality of insulation displacement connectors 28. The insulation displacement connectors 28 electrically connect, within the interior of the housing 12, to contact springs 30 positioned within the receptacle 26. In general, in an RJ-45 jack, eight contact springs 30 are aligned in an array, and positioned to engage with contacts of a complementary RJ-45 plug.

In connection with the present disclosure, it is recognized that various sizes of telecommunications plugs will fit within a telecommunications jack can include those sized up to and including the RJ-45 plug. As illustrated in the comparison of FIGS. 2A-2B and 3A-3B, an RJ-11 plug 50 has an analogous vertical size to an RJ 45 plug 60; however, where the RJ-11 plug 50 has six horizontally spaced contacts 52, the RJ-45 plug 60 has eight such contacts 62. As is known in the art, the contacts 52, 62 of each plug are recessed within a body 54, 64 respectively of each plug in slots 56, 66, respectively, such that, when inserted into a complementary jack, contact springs of the jack must enter slots of the plug to engage with the contacts. Additionally, the RJ-45 plug 60 has a horizontal width greater than that of the RJ-11 plug 50. However, the RJ-11 plug 50 is sized such that, when inserted into a telecommunications jack such as jack 10 of FIG. 1, a portion (shown as region 53)70 of the plug 50 is aligned with at least some of the contact springs 30 of the jack 10. In particular, since both an RJ-45 plug 60 and an RJ-11 plug 50 are centered within the jack 10 when inserted, but the RJ-11 plug 50 only has six contacts 52, the first and eighth contact springs 30 of the jack 10 are not aligned with corresponding contacts 52. Rather, these contact springs are aligned with a housing portion of the RJ-11 plug 50, and are deflected to a greater extent than they would be otherwise by typical contact of an RJ-45 plug 60.

Figure 4:
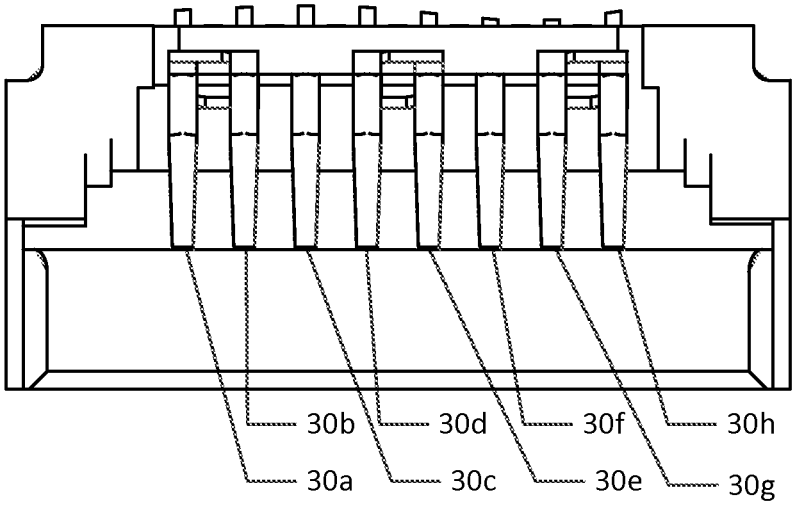
FIG. 4 illustrates an array of contacts deflected uniformly by an RJ-45 plug.
Figure 5:
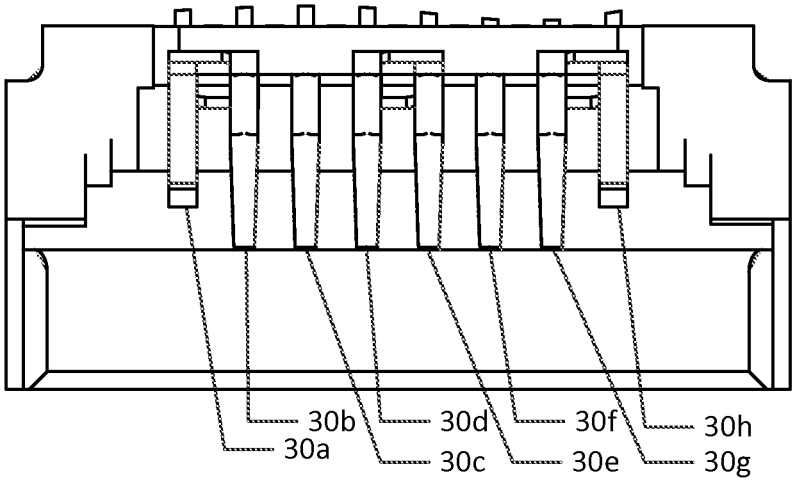
FIG. 5 illustrates an array of contacts having first and eighth contacts deflected further due to insertion of an RJ-11 plug.
Figure 6:
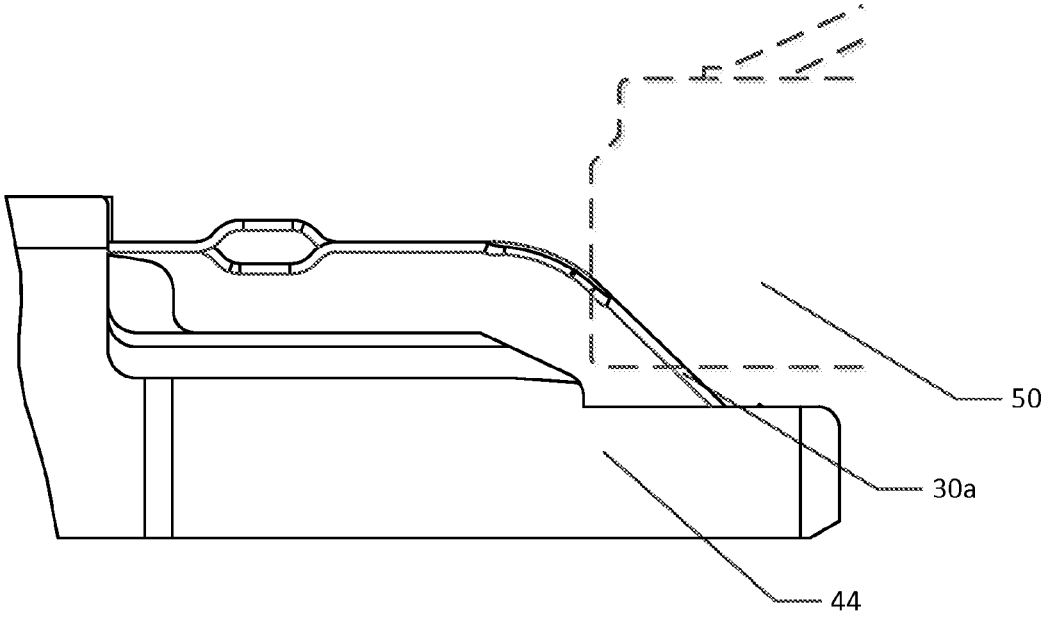
FIG. 6 illustrates a front view of an array of contacts deflected uniformly by an RJ-45 plug.
Figure 7:
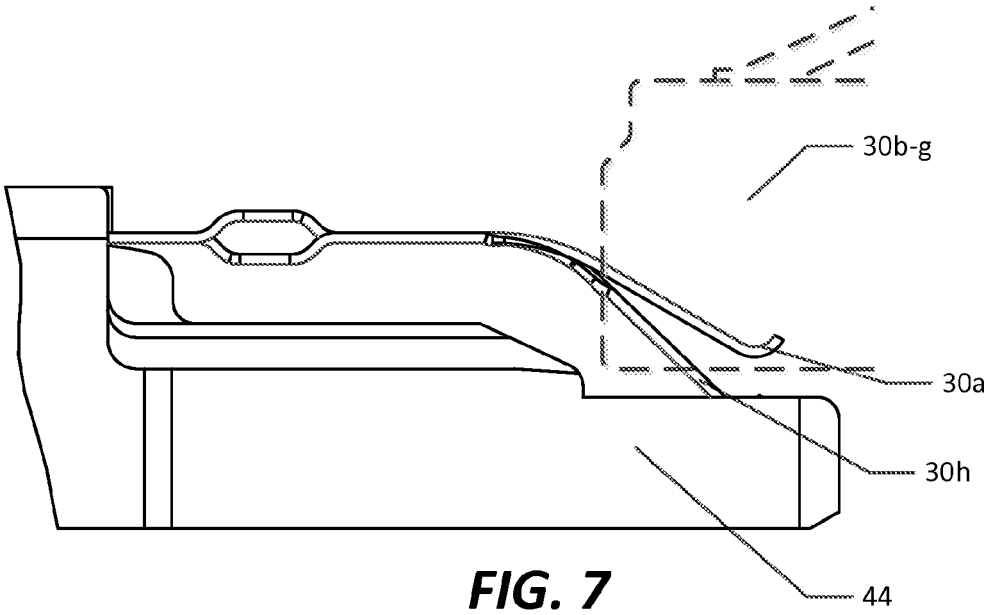
FIG. 7 illustrates a front view of an array of contacts deflected non-uniformly by an RJ-11 plug.

This arrangement is illustrated in FIGS. 4-7, which depict varying deflection effects of insertion of an RJ-11 plug, such as plug 50, into a jack, such as jack 10, that is sized and arranged to receive an RJ-45 plug. As illustrated in those figures, contact springs 30*a-h* are arranged generally linearly. In FIGS. 4 and 6, contact springs 30*a-h* are deflected a uniform amount, reflecting the fact that each of the springs is either entirely unengaged or is engaged with a contact of a uniform contact array, such as contacts 62 of the RJ-45 plug 60. In contrast, in FIGS. 5 and 7, contact springs 30*a-h* are deflected varying amounts, as may be the case where an RJ-11 plug is inserted into an RJ-45 jack. In particular, first and eighth contact springs 30*a*, 30*h* are deflected a first distance that is greater than the second distance of deflection experienced by contact springs 30*b-g*, since those contact springs are engaged by a body 54 of the RJ-11 plug, rather than a contact of the plug which is recessed within the body of the plug in a slot 56.

It is noted that, over time, if a mismatched plug is inserted into a jack and causes repeated, unexpectedly-large deflection of the contact springs 30*a*, 30*h*, it is possible that these contact springs will not rebound to a starting position, but will rather remain deflected. In such scenarios, if a matched plug (e.g., an RJ-45 plug) is inserted into the jack, that matched plug may not make electrical contact with the now-fatigued contact springs 30*a*, 30*h*. Although in some cases a high-resiliency material could be employed, it is unneeded and unnecessarily expensive to be used for all of the "middle" contact springs 20*b-g*.

Figure 8:
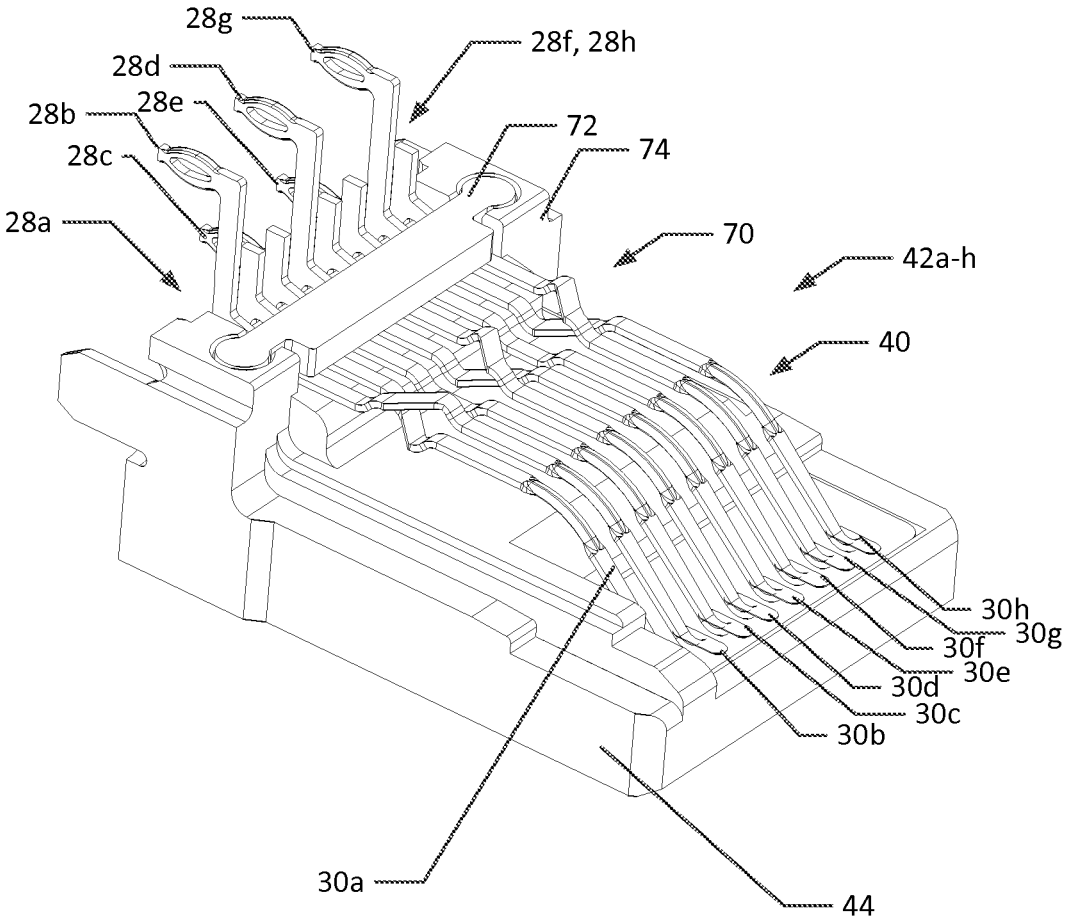
FIG. 8 is a perspective view of a telecommunications jack having a portion of the housing removed.
Figure 9:
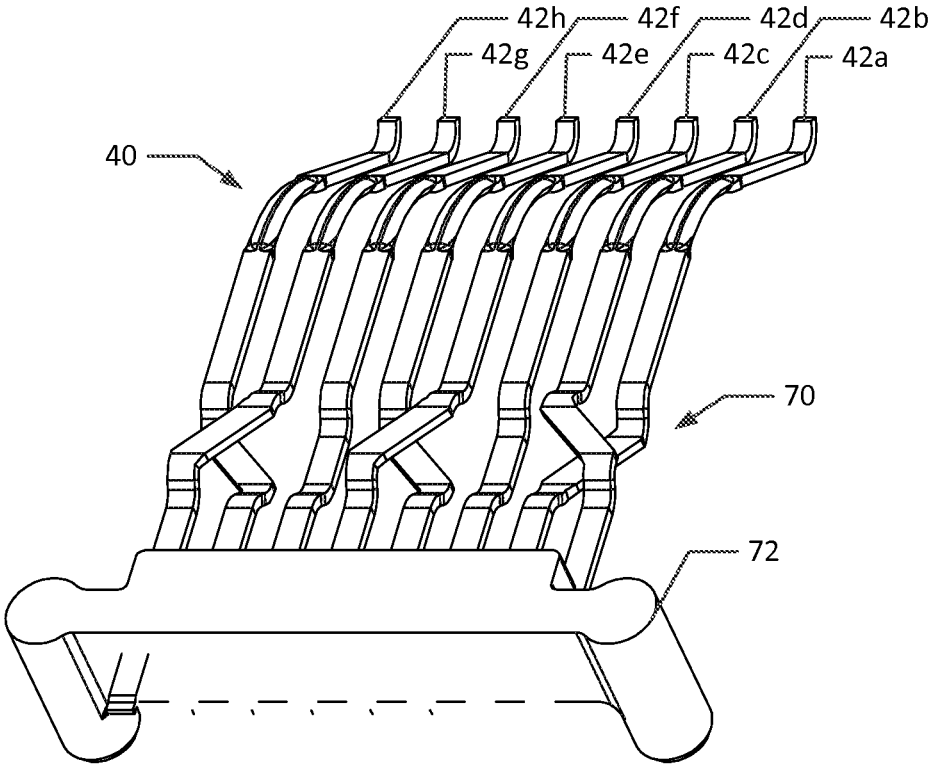
FIG. 9 is a rear perspective view of a contact array useable within a telecommunications jack.
Figure 10:
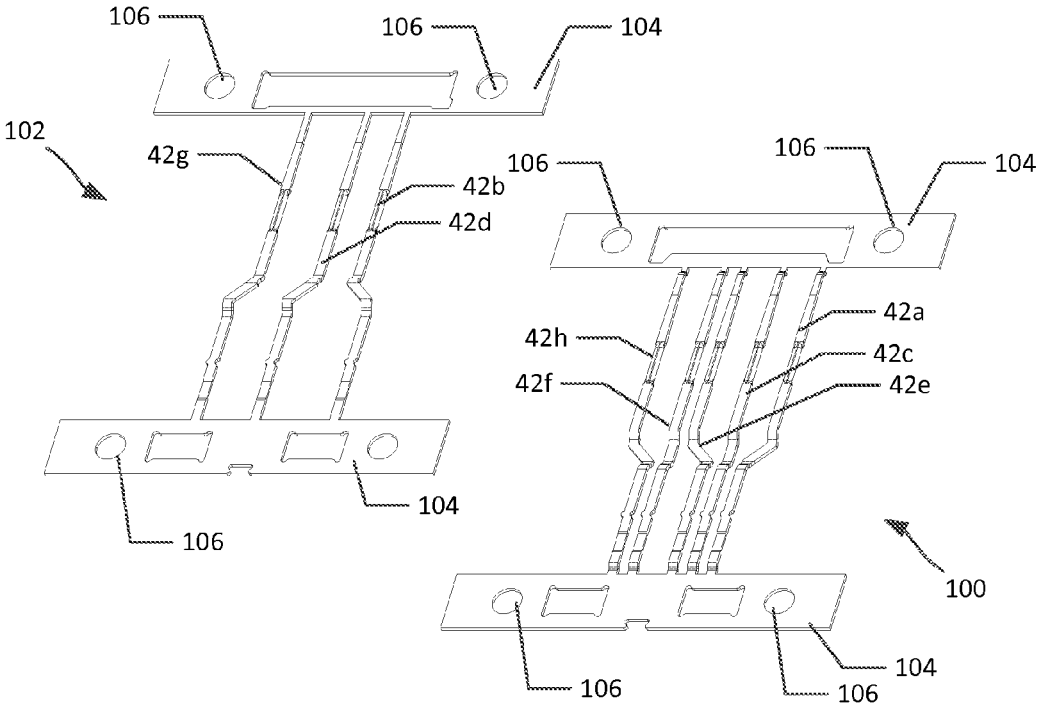
FIG. 10 is a perspective view of contact strips useable to manufacture a telecommunications jack according to embodiments of the present disclosure.

Referring to FIGS. 8-10, an example arrangement addressing the issue of deflection is shown in which different subsets of contact springs of a particular telecommunications jack are manufactured from materials having different properties. In particular, contact springs within a telecommunications jack, such as jack 10, can be constructed using different materials having different resiliencies, and different costs, depending upon the expected stresses applied to those contact springs.

As illustrated in FIGS. 8-9, a portion of the telecommunications jack 10 is illustrated with housing 12 removed. As seen in FIG. 8, contact springs 30 are formed integrally with insulation displacement connectors 28 at an opposite end, and mid-portions 40 therebetween. In this arrangement, the contact springs 30 and insulation displacement connectors 28 are formed from contact strips 42, which each can be stamped or otherwise formed from a metallic or other electrically-conductive material. In the embodiment shown, each of the contact strips 42 are mounted within a jack body 44 which is held within the housing 12. As discussed further below, the contact strips 42 can be, in some embodiments, constructed by stamping an array of such strips from a metallic sheet, as mentioned below in connection with FIG. 10.

In the embodiment shown, the mid-portions 40 of the contact strips 42 include bend locations 48 and, in some embodiments, a crossover zone 70. The crossover zone 70 is positioned, in various embodiments, to address crosstalk generated by differential signal pairs formed by the contact strips within the jack 10. In the embodiment shown, the jack 10 includes eight contact strips 42*a-h*, with first and second contact strips 42*a-b* being interchanged at the crossover zone 70, as well as the fourth and fifth contact strips 42*d-e*, and seventh and eighth contact strips 42*g-h*. In alternative embodiments, more or fewer crossovers can be incorporated into the jack, and can be implemented either using contact strips 42 as shown, or alternative methods such as use of electrical traces on a printed circuit board.

As seen in FIG. 9, an overmolding process can be performed on the contact strips 42, thereby fixing their relative positions. The overmolding process can result in an overmolding 72 that can fit within a corresponding receiving structure 74 of the jack body 44, to affix the contact strips 42 to the jack body 44 (and consequently within the jack 10 when housing 12 is installed over the jack body.

Referring now to FIG. 10, a perspective view of contact strip arrays 100, 102 is provided, according to a possible embodiment of the present disclosure. The contact strip arrays 100, 102 can be used to form the contact strips 42 of FIGS. 8-9, above. The contact strip arrays 100, 102, are, according to the embodiments discussed herein, formed from differing materials. For example, a first contact strip array 100 can be formed from a beryllium-copper alloy, or some other conductive material having a high resiliency, while the second contact strip array 102 can be formed from a lower-cost alloy material, such as a nickel silicon alloy, or a phosphorous bronze alloy. The contact strip arrays 100, 102 can be formed in any of a variety of processes. In an example embodiment, the contact strip arrays 100, 102 are stamped from plates of the selected source materials. In alternative embodiments, other manufacturing processes could be used to form the contact strip arrays, and associated contacts strips 42 (including contact springs 30).

In the embodiment shown, the contact strip arrays 100, 102 are formed such that, at opposing ends of the contact strips 42 of each array, alignment features are included. In the embodiment shown, each of the contact strip arrays 100, 102 includes an alignment mount 104 on each side. The alignment mount 104 allows the contact strip arrays 100, 102 to be mounted to a bending apparatus for forming the contact strips 42*a-h* as illustrated in FIGS. 8-9 (for example via alignment holes 106). The alignment mounts 104 also allow the contact strip arrays 100, 102 to be aligned with each other before being separated from the mount 104. For example, in some embodiments, during manufacturing the contact strip arrays 100, 102 are formed as shown in FIG. 10, then the contact strips are bent into a desired geometry and constrained together, for example by an overmolding process. Following the overmolding process, the contact strips 42, now having fixed relative positions, are mounted to a jack body 44. Finally, the alignment mounts 104, 106 can be removed from the contact strip arrays and a housing 12 can be placed over the jack body, thereby encasing the contact strips 42 within the telecommunications jack 10.

Generally, the first contact strip array 100 includes at least the first and eighth contact strips 42*a*, 42*h*, and in the embodiment shown includes the first, third, fifth, sixth, and eighth contact strips, 42*a*, 42*c*, 42*e*, 42*f*, 42*h*, respectively. Concurrently, the second contact strip array 102 includes at least some of the contact strips 42 forming contact springs of the inner contacts not expected to be deformed by an RJ-11 connector; in the embodiment shown, the second contact strip array 102 includes the second, fourth, and seventh contact strips 42*b*, 42*d*, and 42*g*, respectively.

In addition to forming the various contact strip arrays 100, 102 from different materials, the use of two different contact strip arrays allows the manufacturing process to be performed such that alignment of the contact strips is straightforward. For example, because first and second contact strips 42*a-b* form a crossover in the crossover zone 50, these contact strips are located on different contact strip arrays and located in an intended relative position on the contact strip. The same is true of the fourth and fifth contact strips 42*d*, 42*e*, and seventh and eighth contact strips 42*g*, 42*h*, which are on contact strip arrays 102, 100, respectively. Using the contact strips in the order and positioning in which they are formed on the contact strip arrays 100, 102 allows for the contact strip arrays to simply be bent to a desired geometry and overlaid on each other, resulting in the aligned arrangement illustrated in FIGS. 8-9.

It is noted that although in the embodiment shown, five of the contact strips are constructed from a material having a higher resiliency, this arrangement is one of manufacturing convenience based on the selected crossovers included at the crossover zone 50. In alternative embodiments in which different sets of cross-over arrangements are used, it may be convenient to include different contact strips on different contact strip arrays. Generally, the main constraint is to include at least the contact strips expected to encounter greater stresses or displacement (e.g., the outer contact strips 42*a*, 42*h*) to be included in a contact strip array constructed from a high resiliency material, while at least some of the other contact strips that are expected to encounter lesser stresses or displacement (e.g., one or more of the contact strips 42*b-g*) to be included in a contact strip array constructed from a lower resiliency material. Furthermore, although one example process for constructing a telecommunications jack is described herein, it is noted that other possible processes can be used, and different orders of method steps could be performed to equivalently construct such a telecommunications jack.

Additionally, and referring to FIGS. 1-10 generally, it is noted that although in the present application use of contact materials of differing types is discussed in the context of an RJ-45 jack capable of receiving either a corresponding RJ-45 plug or a different, smaller plug (e.g., RJ-11), it is noted that application of the concepts disclosed herein is not so limited. For example, use of such different contact materials could be implemented in a jack having a different format, such as an RJ-50 jack which includes five pairs of contacts. In such a case, the outermost contact strips could be constructed from a material of higher resiliency, which would be deformed a greater amount by a smaller plug, such as an RJ-45 plug. In such a case, the inner eight wires could be constructed from a lower-cost, less resilient material. In still further embodiments, the outer two contact strips from each edge of the contact array of an RJ-50 jack could be constructed from a higher resiliency material, thereby accommodating RJ-45, RJ-11, or other smaller-format plugs while allowing use of a lower cost, lower resiliency material on the innermost four contact strips.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A telecommunications jack comprising:

a housing having a socket adapted to receive an RJ-45 plug;

a plurality of contact springs exposed within the socket;

wherein the plurality of contact springs are resiliently compressible and include a first subset of contact springs and a second subset of contact springs, the first subset of contact springs being manufactured from a first material having a first resiliency and the second subset of contact springs being manufactured from a second material having a second resiliency higher than the first resiliency.

2. The telecommunications jack of claim 1, wherein the second material comprises a beryllium-copper alloy and the first material comprises at least one of a nickel silicon material and a phosphorous bronze material.

3. The telecommunications jack of claim 1, wherein the plurality of contact springs includes first, second, third, fourth, fifth, sixth, seventh, and eighth contact springs.

4. The telecommunications jack of claim 3, wherein the second subset of contact springs includes the first and eighth contact springs.

5. The telecommunications jack of claim 4, wherein the second subset of contact springs includes the fifth contact spring.

6. The telecommunications jack of claim 1, wherein the first subset of contact springs includes the second, fourth, and seventh contact springs.

7. The telecommunications jack of claim 1, wherein the socket is sized to receive either of an RJ-45 plug or an RJ-11 plug.

8. The telecommunications jack of claim 7, wherein the plurality of contact springs is arranged in alignment with electrical contacts of an RJ-45 plug.

9. The telecommunications jack of claim 1, wherein the first subset of contact springs includes at least one contact spring arranged to be aligned with a corresponding electrical contact of an RJ-45 plug when an RJ-45 plug is inserted in the socket, the at least one contact spring further arranged to be aligned with a body of an RJ-11 plug when an RJ-11 plug is inserted in the socket.

10. The telecommunications jack of claim 1, wherein, when an RJ-45 plug is inserted into the socket, the at least one contact spring is displaced a first distance, and when an RJ-11 plug is inserted in the socket, the at least one contact spring is displaced a second distance greater than the first distance.

11. A telecommunications jack comprising:

a housing having a socket adapted to receive either a first telecommunications plug of a first type or a second telecommunications plug of a second type, the second telecommunications plug having a different arrangement of electrical contacts as compared to the first telecommunications plug;

a plurality of contact springs exposed within the socket, the plurality of contact springs positioned for alignment with electrical contacts of the first telecommunications plug when the first telecommunications plug is inserted into the socket, a first subset of the plurality of contact springs positioned for alignment with electrical contacts of the second telecommunications plug when the second telecommunications plug is inserted into the socket;

wherein the plurality of contact springs are resiliently compressible and include the first subset of contact springs and a second subset of contact springs, the first subset of contact springs being manufactured from a first material having a first resiliency and the second subset of contact springs being manufactured from a second material having a second resiliency higher than the first resiliency.

12. The telecommunications jack of claim 11, wherein, when a first telecommunications plug is inserted into the socket, at least one contact spring of the second subset of contact springs is displaced a first distance, and when a second telecommunications plug is inserted in the socket, the at least one contact spring is displaced a second distance greater than the first distance.

13. The telecommunications jack of claim 11, wherein the first subset of contact springs comprise array strips stamped from a plate of the first material, and the second subset of contact springs comprise array strips stamped from a plate of the second material.

14. The telecommunications jack of claim 13, wherein the second material comprises a beryllium-copper alloy and the first material comprises at least one of a nickel silicon material and a phosphorous bronze material.

15. The telecommunications jack of claim 13, wherein the plurality of contact springs includes at least one crossover zone formed by adjacent ones of the plurality of contact springs.

16. The telecommunications jack of claim 11, wherein the housing has an opening sized to receive an RJ-50 plug.

17. The telecommunications jack of claim 11, wherein the plurality of contact springs are arranged linearly and include at least first, second, third, fourth, fifth, sixth, seventh, and eighth contact springs.

18. The telecommunications jack of claim 11, further comprising a plurality of insulation displacement connectors electrically connected to the corresponding plurality of contact springs.

19. The telecommunications jack of claim 18, wherein the contact springs and insulation displacement connectors are integrally formed from contact strips.

20. The telecommunications jack of claim 11, wherein contact strips comprise metallic leads.

* * * * *